United States Patent [19]

Morrison

[11] Patent Number: 4,611,812

[45] Date of Patent: Sep. 16, 1986

[54] BALL GAME GOAL

[75] Inventor: Howard J. Morrison, Deerfield, Ill.

[73] Assignee: Marvin Glass & Associates, Chicago, Ill.

[21] Appl. No.: 734,543

[22] Filed: May 16, 1985

[51] Int. Cl.[4] ..... A63B 63/08

[52] U.S. Cl. ..... 273/400

[58] Field of Search ..... 273/398–402, 273/1.5 R, 1.5 A

[56] References Cited

U.S. PATENT DOCUMENTS

| | | | |
|---|---|---|---|
| 532,132 | 1/1895 | Zaremba | 273/400 |
| 1,211,379 | 1/1917 | Maisch | 273/400 X |
| 1,258,931 | 3/1918 | Newcombe | 273/402 |
| 3,421,764 | 1/1969 | Smith et al. | 273/402 X |
| 3,445,114 | 5/1969 | Fernandez | 273/400 X |
| 3,495,830 | 2/1970 | Farrelli | 273/400 |
| 3,602,505 | 8/1971 | Friend | 273/400 X |

*Primary Examiner*—Paul E. Shapiro

*Attorney, Agent, or Firm*—John S. Pacocha

[57] ABSTRACT

A portable, elevated, ball receiving game apparatus including an open topped, closed bottom lightweight plastic basket supported upon a single, central, elongated stem. The end of the stem opposite the basket is securable in a base having radially extending feet sufficient to support the apparatus upon a generally planar surface. Pegs are provided to further secure the base into a relatively soft ground surface. The stem is made of a tubular plastic material of a diameter of approximately one inch so as to permit a player to grasp the stem at a point intermediate the basket and the base and by exerting a force in a plane generally transverse to the generally vertically oriented axis of the stem effect sufficient, repeated, displacement of the basket from its initial orientation to cause the ball to be ejected out of the basket. To enhance portability and storage as well as to provide for varying heights of the elevated basket, the stem is preferably made of connectable sections.

17 Claims, 4 Drawing Figures

BALL GAME GOAL

BACKGROUND OF THE INVENTION

1. Field of the Invention

This invention relates generally to a ball game goal and more particularly to a game apparatus providing a portable, elevated, closed bottom, ball receiving goal with simplified means for ejecting the received ball.

2. Background Art

Games, such as basketball, in which a ball is tossed at, or into, a goal, are popular pastimes. One method of effecting the return of a successfully aimed ball is to provide a pass-through goal, such as the open bottom net used in basketball. There is, however, some satisfaction to be obtained from seeing the ball reside within the goal rather than momentarily passing through it. Moreover, with a pass-through goal there may at times be a dispute whether the ball actually went through the goal. A pass-through goal, such as that used in basketball, also may present some difficulties in portably mounting the goal at an elevated position. Versions of a single, central, standard mount for a pass-through goal are shown in U.S. Pat. Nos. Des110,225 and 2,194,779. Attempts to provide a central support for a closed bottom goal and a means for ejecting the received ball are shown in U.S. Pat. Nos. 2,278,616 and 3,602,505. There remains a need, however, for a simplified, portable, elevated, closed bottom ball receiving goal from which the ball can be ejected without any complicated mechanism.

SUMMARY OF THE INVENTION

The present invention is concerned with providing a portable, elevated, closed bottom ball game goal apparatus with a simple means for ejecting the received ball. These and other objects and advantages of the invention are achieved by providing a ball receiving goal that is elevated upon an elongated stem with a normally, generally vertically oriented axis. One end of the stem is securable to a ground supported base and the other is attached to the closed bottom ball receiving basket. The flexibility of the stem relative to its height permits sufficient bending of the stem to eject the ball from the basket when the stem is grasped at a point intermediate the ends by a player and flexed by a force exerted in a plane generally transverse to the axis of the stem.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
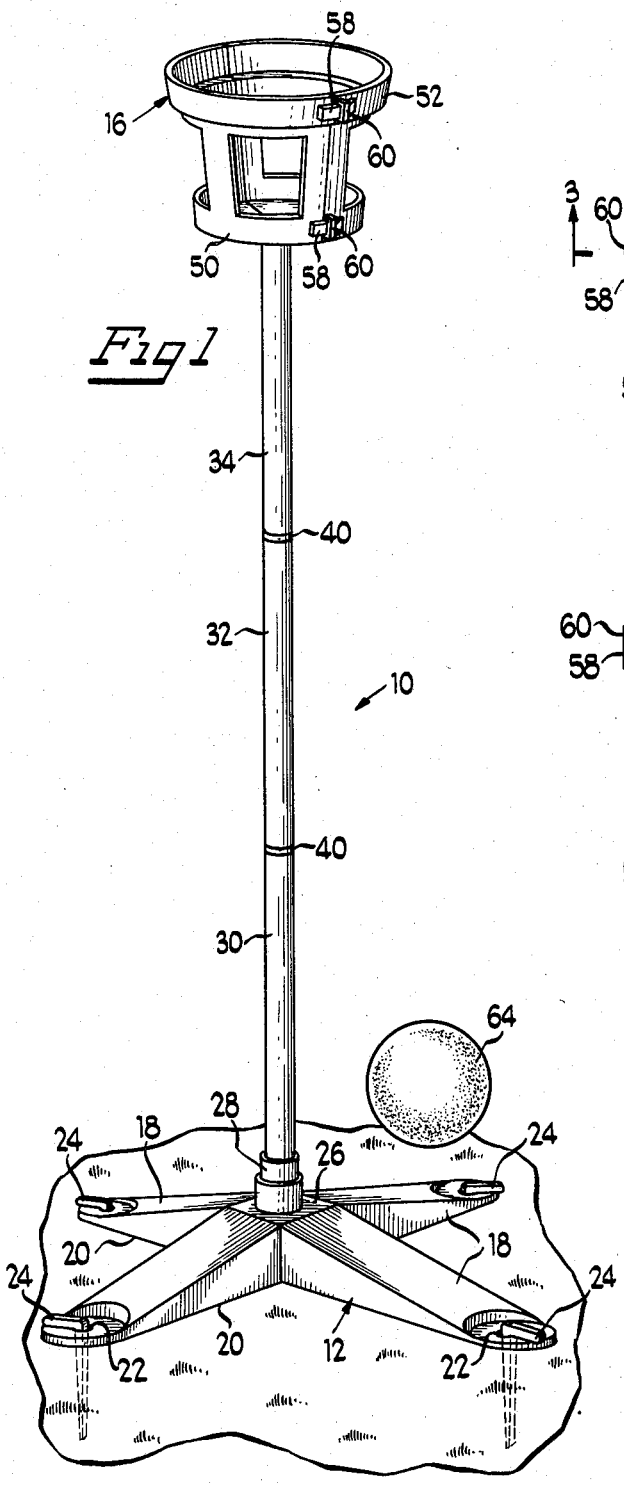
FIG. 1 is a perspective view of a game apparatus embodying the present invention.
Figure 2:
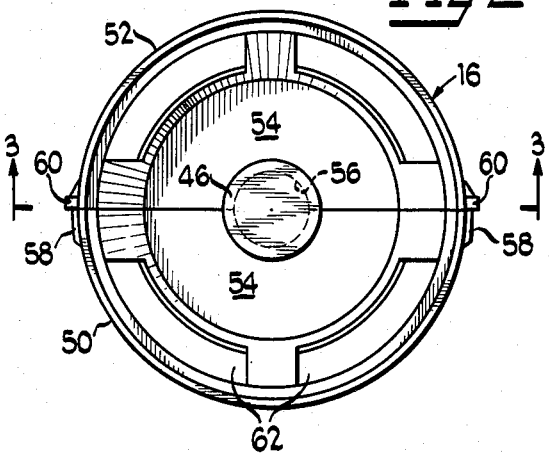
FIG. 2 is an enlarged scale, top plan view of the upper portion of the game apparatus omitting the base.

Referring now to the drawing in which like parts are designated by like reference numerals throughout the several views, there is shown in FIG. 1 a ball goal receiving game including a portable, elevated, closed bottom, ball receiving goal 10. The goal includes a base

12, central tubular supporting stem 14 and an open top ball receiving basket 16. Base 12 has four radially extending feet 18 each having a substantially flat underside 20 and an aperture 22 adjacent the outer end. As shown in FIG. 1, the base is secured on a lawn or other irregular soft ground surface by means of L-shaped pegs 24 which pass through the aperture 22 into the ground. Goal 10 may also be used on any substantially planar hard surface such as concrete or an indoor floor.

Extending upwardly from the central hub 26 of the base is a cylindrical socket 28. Tubular stem 14 fits into socket 28 with the axis of the stem being generally vertically oriented. For enhanced portability, and to facilitate storage of the apparatus when it is not in use, stem 14 is a combination of three tubular sections 30, 32 and 34. An overall height of the central supporting stem of about seven feet provides sufficient challenge and entertainment for adults and still permits play of the game by older children. For play by younger, shorter children, one of the sections of stem 14 may be removed to provide an overall stem height of about four or five feet. As shown in FIG. 1, the three sections 30, 32 and 34 are approximately of equal height. However, it may be desirable to make the sections of dissimilar heights to permit selective combination of two sections to obtain one of three different heights.

Adjacent ones of the tubular sections 30, 32 and 34 are connected together by means of a connector plug 36 which has a cylindrical body 38 of a diameter to fit snugly within the inside of the tubular section. Approximately at the midpoint of the cylindrical body, the connector body has an enlarged flange 40, the outside diameter of which is conveniently the same as the outside diameter of the tubular sections. Inserted into the open top of the uppermost tubular section 34 is a basket mounting plug 42 having a downwardly depending cylindrical body 44 of the same diameter as the cylindrical body 38 of the connector plug 36. At the top, basket mounting plug 42 has an enlarged head 46 of a diameter significantly greater than the outside diameter of tubular section 34. Head 46 has an annular groove 48 at approximately the midpoint of the height of the head.

Figure 3:
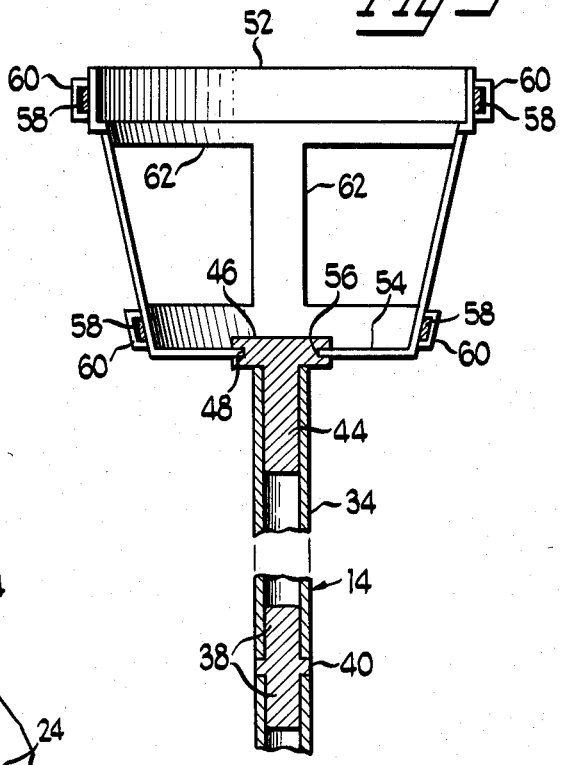
FIG. 3 is a partial view taken in section generally along Line 3—3 of FIG. 2.
Figure 4:
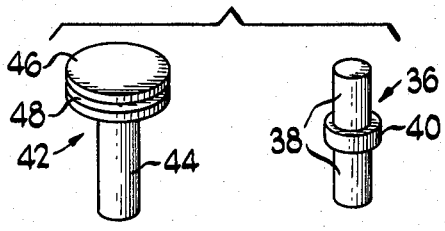
FIG. 4 is a enlarged scale, perspective view of two of the components.

Ball receiving basket 16, which is generally in the form of an inverted truncated cone, is formed of two mating halves 50 and 52. The basket conveniently has about a twelve inch diameter open top, about an eight inch diameter closed bottom and is about eight inches high. Each of the halves has a semitoroidal bottom wall 54. When the two halves are secured together the mating bottom walls 54 define a cylindrical opening 56 having a diameter less than the outer diameter of head 46 and approximately equal to the diameter of the inside of annular groove 48. Accordingly, as is best illustrated in FIG. 3, the two basket halves are secured about mounting plug 42 and in combination with the mounting plug form a closed bottom ball receiving goal.

To secure halves 50 and 52 together, half 50 is provided with a pair of upper and lower barbs 58 which are secured in mating C-shaped staples 60 on basket half 52. Basket halves are conveniently molded of a plastic material and the barbs and staples are integrally formed. The plastic is sufficiently resilient to permit flexing of the barb and staple latches to permit assembly and disassembly. Both to reduce the weight of the basket and to provide visibility of the ball when it is in the goal, the sidewall is provided with openings 62.

A ball 64 of a diameter that may be as large as the diameter of the bottom of the basket 16, but is conveniently of a diameter of approximately seven and one-half inches, is provided as part of the game apparatus. Ball 64 should be made of a soft expanded foam material or be hollow so as to provide a relatively lightweight ball. Play of the game with the apparatus 10 may follow a variety of rules. In one form, the game may be played like basketball. As an alternative, players may form teams on different sides of the apparatus and hit the ball in volleyball fashion to put the ball in the goal.

After the ball is in the goal, it may be ejected by a player grasping stem 14 at any convenient point intermediate the base and the basket and then exerting a force in a plane generally transverse to the axis of the elongated stem. Preferably the force is exerted in a circular motion causing the basket to whip around in a cyclonic-like manner which forces the ball by centrifugal force to roll around and up the sides of the truncated conical basket and then out the open top. A reciprocating force exerted directly transverse to the axis of the stem to whip the stem back and forth will also eject the ball although a more violent force is required.

In order to permit this simplified means of ejecting the ball from the elevated goal, it is necessary that the tubular stem be relatively thin as compared to the prior art devices. Stems made of PVC material with an outer diameter of approximately seven-eighths of an inch and an inside diameter of about five-eighths of an inch resulting in a one-eighth inch wall thickness work well in accordance with this invention with stems having an overall height of about seven feet. Similarly, stems formed of plastic such as polypropylene having an outside diameter of about one and one-sixteenth inch, an inside diameter of approximately fifteen-sixteenths of an inch and a wall thickness of one-sixteenth of an inch also work well. Both of these stems also function in accordance with the invention even when the height of the stem is reduced down to a single section as long as the outer diameter of the tubular stem is no more than about 1/20 the height. These materials and the relatively thin, tubular stems are sufficiently rigid to support the lightweight basket 16 with the axis of the stem in a generally vertical orientation while being sufficiently flexible to permit flexing of the stem at an angle to the normally vertically oriented axis to provide sufficient lateral movement to eject ball 64.

While a particular embodiment of the invention has been shown and described, it will be apparent to those skilled in the art that changes and modifications may be made without departing from the invention. It is intended in the appended claims to cover all such changes and modifications as fall within the true spirit and scope of the invention.

What is claimed as new and desired to be secured by Letters Patent is:

1. A portable, elevated, ball receiving game comprising:

a base;

a generally vertically oriented, elongated height stem, one end of which is securable to the base;

the stem having an outer diameter of approximately one inch;

an open top ball receiving basket with a closed bottom attached to the other end of the stem;

a ball sized to be received within the basket; and the flexibilty of the stem providing means for ejecting the ball from the basket through the open top.

2. The game of claim 1 in which the stem comprises connectable sections with each section being a tube joinable together by connector means.

3. The game of claim 1 in which the basket comprises an inverted truncated cone.

4. The game of claim 1 in which the stem is tubular and the outer diameter is no more than approximately one-twentieth of the overall height of the stem.

5. The game of claim 4 in which the wall thickness of the tubular stem is between about one-sixteenth and about one-eighth of an inch.

6. The game of claim 1 in which the stem is made of plastic and is rigid enough to support the basket and ball but is sufficiently flexible to permit flexing of the stem by a player grasping the stem intermediate the basket and the base and exerting a force in a plane generally transverse to the axis of the stem.

7. The game of claim 6 in which the stem is tubular with a wall thickness of between about one-sixteenth and about one-eight of an inch.

8. The game of claim 1 including means for securing the base to a ground supporting surface.

9. The game of claim 1 in which the stem is sufficiently rigid to remain generally vertically oriented while supporting the basket, but is sufficiently flexible to be readily deflected from the vertical orientation by a player exerting a force in a plane generally transverse to the vertical orientation at approximately the midpoint of the stem.

10. The game of claim 9 in which the stem is tubular with a wall thickness is approximately one-eighth of an inch.

11. The game of claim 9 in which the stem is tubular with a wall thickness is approximately one-sixteenth of an inch.

12. The game of claim 1 in which the height of the stem is about seven feet.

13. The game of claim 1 in which the stem is tubular with a wall thickness is approximatley one-eighth of an inch.

14. The game of claim 1 in which the stem is tubular with a wall thickness is approximately one-sixteenth of an inch.

15. A method of ejecting a ball from an elevated, closed bottom, ball receiving goal that is supported upon an elongated stem with a generally vertically oriented axis comprising the steps of:

the player grasping the stem at a point intermediate the basket and the base; and the player exerting a force in a plane generally transverse to the axis of the stem resulting in the basket being repeatedly displaced from its initial orientation so as to cause ejection of the ball from the basket.

16. The method of claim 15 in which the force is exerted in a circular motion in the generally transverse plane.

17. The method of claim 15 in which the force is exerted in a reciprocating manner in the generally transverse plane.

* * * * *